US007508142B2

(12) United States Patent
Green

(10) Patent No.: US 7,508,142 B2
(45) Date of Patent: Mar. 24, 2009

(54) BALLAST CONTROL CIRCUIT FOR USE WITH CCFL AND EEFL LAMPS

(75) Inventor: Peter Green, Redondo Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 11/779,065

(22) Filed: Jul. 17, 2007

(65) Prior Publication Data

US 2008/0018262 A1 Jan. 24, 2008

Related U.S. Application Data

(60) Provisional application No. 60/807,666, filed on Jul. 18, 2006.

(51) Int. Cl.
*H05B 37/00* (2006.01)

(52) U.S. Cl. ..... 315/224; 315/219; 315/307; 315/308

(58) Field of Classification Search ..... 315/209 R, 315/210, 211, 212, 219, 224, 225, 226, 246, 315/247, 250, 254, 276, 283, 291, 307, 308, 315/312, 360, DIG. 4, DIG. 7
See application file for complete search history.

(56) References Cited

U.S. PATENT DOCUMENTS 5,612,597 A * 3/1997 Wood ..... 315/293
6,002,213 A * 12/1999 Wood ..... 315/307
6,864,645 B2 * 3/2005 Sun et al. ..... 315/308
7,199,528 B2 * 4/2007 Quazi ..... 315/247

* cited by examiner

*Primary Examiner*—David Hung Vu
(74) *Attorney, Agent, or Firm*—Ostrolenk, Faber, Gerb & Soffen, LLP

(57) ABSTRACT

A ballast control circuit for driving at least one gas discharge lamp in accordance with an embodiment of the present application includes a high side driver operable to provide a high side driving signal to a high side switch of a half bridge controlled by the ballast control circuit, wherein the high side driving signal indicates a preferred duty cycle for the high side switch, a low side driver operable to provide a low side driving signal to a low side switch of the half bridge, wherein the low side driving signal indicates a preferred duty cycle for the low side switch and a dead time control circuit operable to provide a dead time signal that indicates a dead time during which both the high side and low side switches are turned OFF, wherein the dead time is set based on a value of an external dead time resistor.

18 Claims, 5 Drawing Sheets

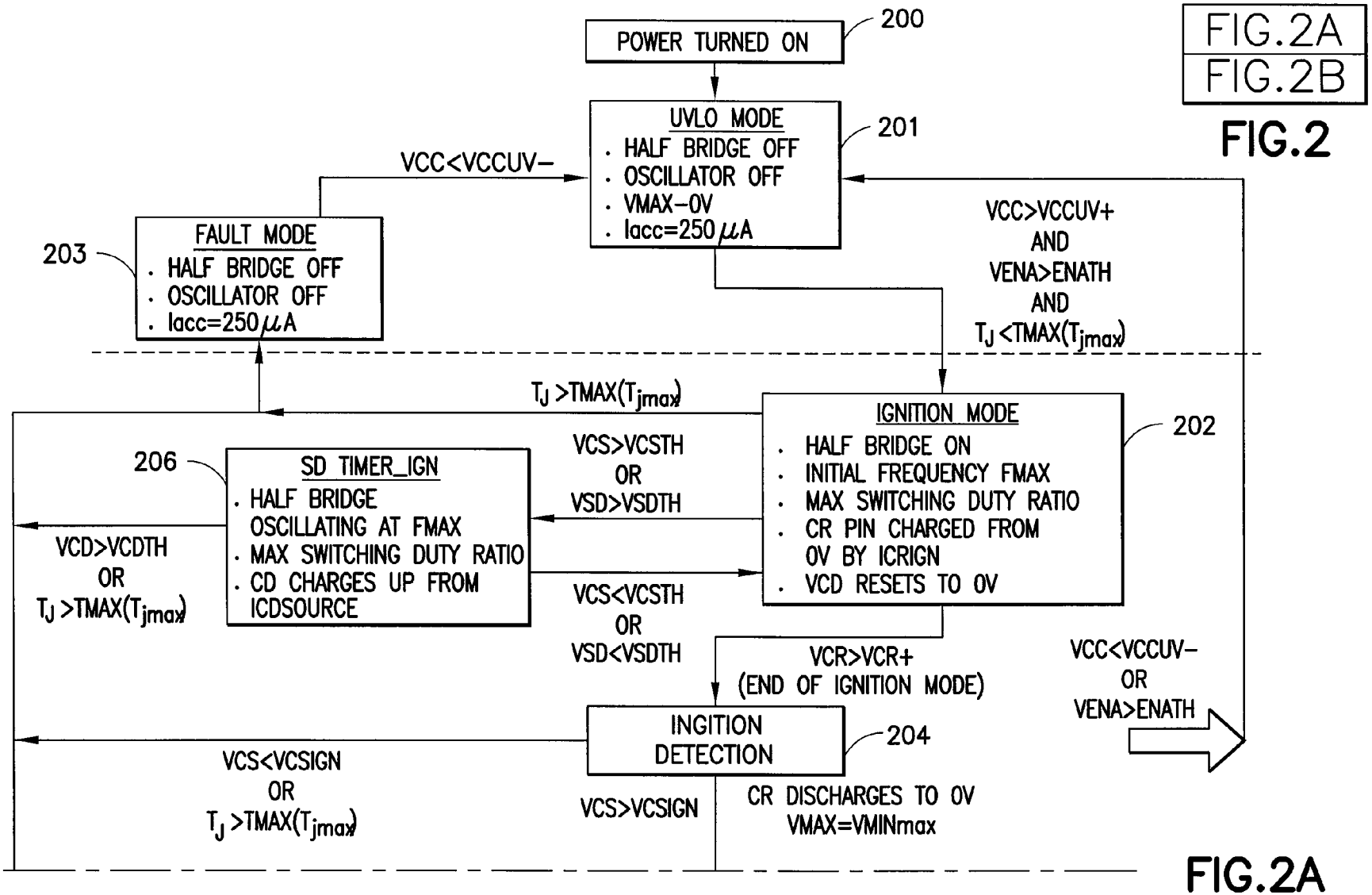
FIG.2A
FIG.2B
FIG.2
FIG.2A
200
POWER TURNED ON
201
UVLO MODE
· HALF BRIDGE OFF
· OSCILLATOR OFF
· VMAX-0V
· Iacc=250 μA
VCC<VCCUV-
203
FAULT MODE
· HALF BRIDGE OFF
· OSCILLATOR OFF
· Iacc=250 μA
VCC>VCCUV+
AND
VENA>ENATH
AND
TJ <TMAX(Tjmax)
202
IGNITION MODE
· HALF BRIDGE ON
· INITIAL FREQUENCY FMAX
· MAX SWITCHING DUTY RATIO
· CR PIN CHARGED FROM
· 0V BY ICRIGN
· VCD RESETS TO 0V
TJ >TMAX(Tjmax)
VCS>VCSTH
OR
VSD>VSDTH
VCS<VCSTH
OR
VSD<VSDTH
206
SD TIMER_IGN
· HALF BRIDGE
OSCILLATING AT FMAX
· MAX SWITCHING DUTY RATIO
· CD CHARGES UP FROM
ICDSOURCE
VCD>VCDTH
OR
TJ >TMAX(Tjmax)
VCC<VCCUV-
OR
VENA>ENATH
VCR>VCR+
(END OF IGNITION MODE)
204
INGITION
DETECTION
CR DISCHARGES TO 0V
VMAX=VMINmax
VCS>VCSIGN
VCS<VCSIGN
OR
TJ >TMAX(Tjmax)

16 VB
15 HO
14 VS
1 VCC
13 LO
2 COM
12 CS
15.6V
PULSE FILTER & LATCH
BOOT STRAP DRIVE
LEVEL SHIFT
OUTPUT LOGIC
308
307
309
313
1.2V
316
OVER CURRENT CONTROL
315
DUTY CYCLE CONTROL
314
SOFT START CONTROL
312
DEAD TIME TIMER + CONTROL
S Q
R1
R2 Q̄
5V
0.2V
S Q
R Q̄
OVER TEMP
310
0.6V
304
ICD
ICT
M1
M2
317
ICR_RUN
2V
306
5V
VBG
0.5V
301
UVLO
5V
300
2V
IGNITION LOGIC
303
305
302
ICR_IGN
M3
BAND GAP REF
10
5 MIN
6 MAX
4 DT
8 ENA
3 CT
10 CD
11 SD
9 CR
7 DIM

BALLAST CONTROL CIRCUIT FOR USE WITH CCFL AND EEFL LAMPS

CROSS-REFERENCE TO RELATED APPLICATIONS

The present application claims the benefit of and priority to U.S. Provisional Patent Application Ser. No. 60/807,666 entitled CCFL BALLAST LCD BACKLIGHT CONTROLLER filed Jul. 18, 2006, the entire contents of which are hereby incorporated by reference herein.

BACKGROUND OF THE INVENTION

The present application relates to an improved ballast control circuit. In particular, the present application relates to an improved ballast control circuit for use in controlling power supplied to one or more CCFL or EEFL lamps.

Most liquid crystal display (LCD) screens and monitors use Cold Cathode Fluorescent Lamp (CCFL) backlighting. Typically, a number of CCFL lamps, which are typically long and thin in shape, are arranged in the LCD in a row to provide backlighting for the screen or monitor. It is important that this backlight have an even intensity in order to ensure that the image on the LCD screen or monitor is properly displayed.

High frequency electronic ballasts are typically used to provide the voltage and power necessary to correctly ignite and supply the lamps. A single ballast is preferably able to power all of the lamps. The ballast should meet certain other criteria as well. The ballast should have a fixed frequency of operation in order to prevent the occurrence of interference patterns on the screen, which may result from interaction between the image scanning frequency and the ballast frequency to produce beat frequencies. Further, the brightness of the lamps should also be controllable, and thus, the ballast must allow for dimming. The dimming method employed for CCFL lamps is preferably PWM burst mode dimming in which the high frequency ballast current driving the lamp is adjusted to control the length of the burst of high frequency current applied to the lamps, and thus, to control the brightness as a function of the RMS current. The frequency of the PWM control signal should be orders of magnitude lower than the ballast frequency, but high enough to prevent any noticeable flicker of the lamps. In addition, the ballast should include fault detection and shutdown features and a designated start up procedure to provide proper control when power is initially applied to the lamps.

The preferred ballast topology for use in CCFL backlighting applications is a half bridge, as is commonly used in general purpose fluorescent ballasts. Such ballast circuits are commonly controlled utilizing a single ballast control circuit which is commonly implemented as an integrated circuit (IC).

Accordingly is desirable to provide a ballast control circuit that meets the requirements set forth above.

SUMMARY OF THE INVENTION

It is an object of the present invention to provide a ballast control circuit for use in controlling a ballast that provides power to a CCFL and/or EEFL.

A ballast control circuit for driving at least one gas discharge lamp in accordance with an embodiment of the present application includes a high side driver operable to provide a high side driving signal to a high side switch of a half bridge controlled by the ballast control circuit, wherein the high side driving signal indicates a preferred duty cycle for the high side switch, a low side driver operable to provide a low side driving signal to a low side switch of the half bridge, wherein the low side driving signal indicates a preferred duty cycle for the low side switch and a dead time control circuit operable to provide a dead time signal that indicates a dead time during which both the high side and low side switches are turned OFF, wherein the dead time is set based on a value of an external dead time resistor.

Other features and advantages of the present invention will become apparent from the following description of the invention which refers to the accompanying drawings.

BRIEF DESCRIPTION OF THE DRAWING(S)

FIGS. 2A and 2B show a state diagram illustrating the modes in which the ballast control circuit operates in accordance with an embodiment of the present application.

DETAILED DESCRIPTION OF PREFERRED EMBODIMENTS OF THE INVENTION

Figure 1:
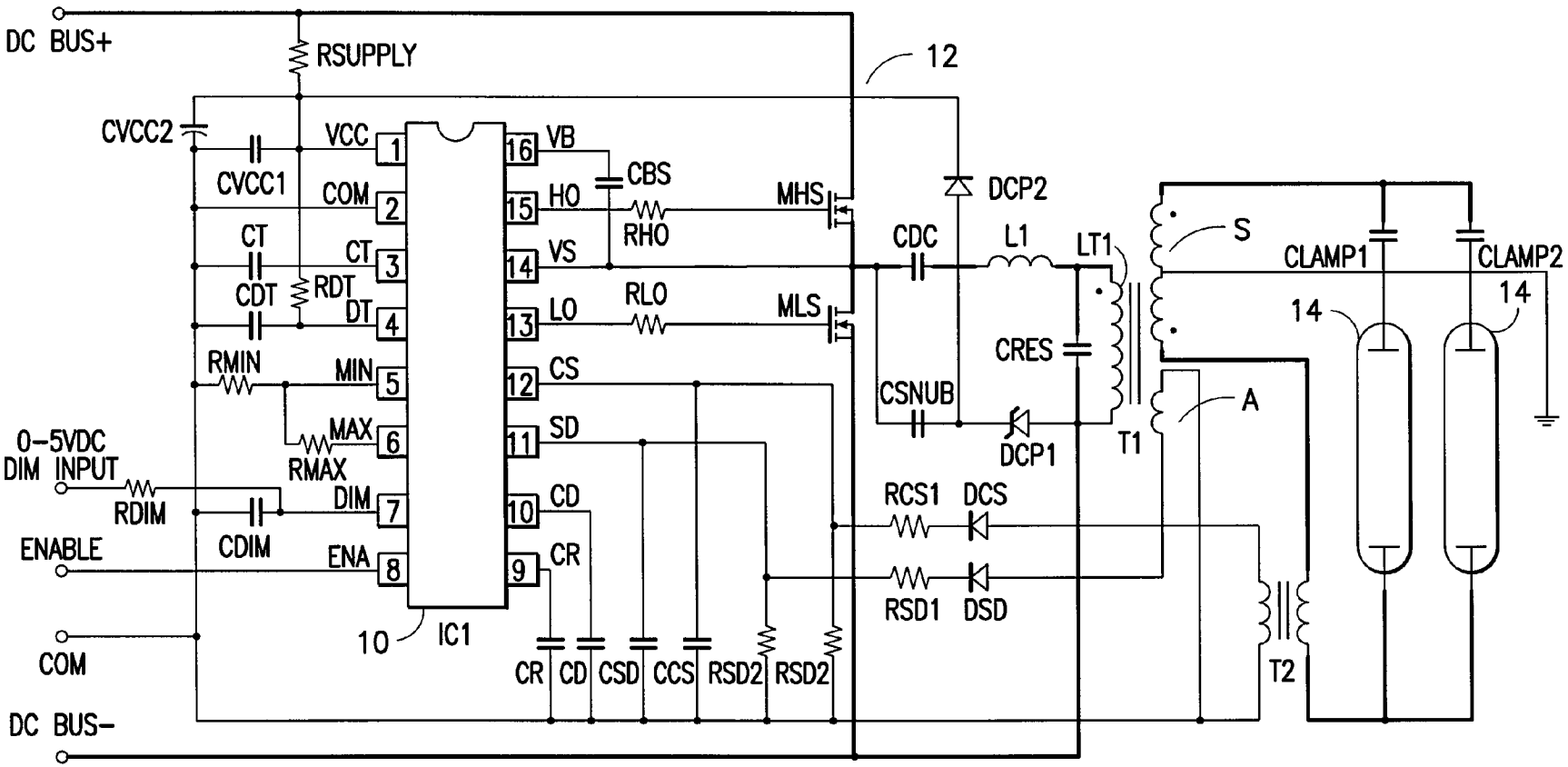
FIG. 1 is a schematic diagram of an application circuit including a ballast control circuit in accordance with an embodiment of the present application which is connected to a half bridge used to power a plurality of gas discharge lamps.
Figure 3:
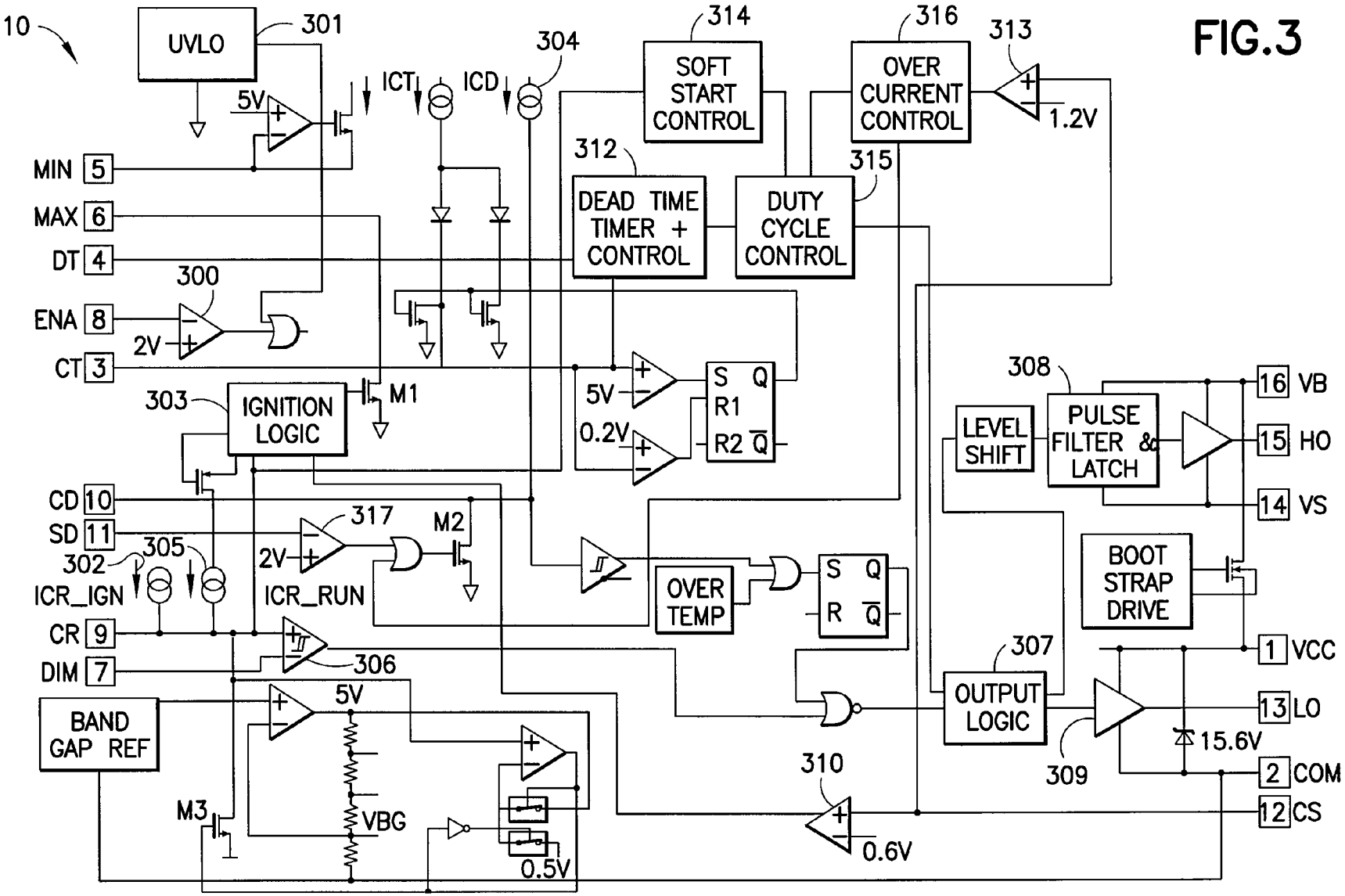
FIG. 3 is a block diagram of the ballast control circuit of FIG. 1.

FIG. 1 is a schematic diagram of an application circuit in which a ballast control circuit 10 in accordance with an embodiment of the present application is used. The ballast control circuit is preferably implemented as an integrated circuit (IC). The ballast control circuit 10 is connected to a half-bridge 12 and controls the half-bridge to power the gas discharge lamps 14. A block diagram of the ballast control circuit 10 is illustrated in FIG. 3. The ballast control circuit 10 preferably controls the half-bridge 12 to power one or more CCFL lamp(s) or External Electrode Fluorescent Lamp(s) (EEFL). More specifically, FIG. 1 illustrates an exemplary embodiment of a ballast control circuit 10 which is implemented as a 16 pin IC and is designated IRS2552. The ballast control circuit 10 includes a high voltage half-bridge driver with a front end that incorporates full control functionality for CCFL/EEFL lamps. The control circuit 10 allows for programmable ignition and supports dimming via analog or PWM control voltage. HVIC and latch immune CMOS technology are preferably included to provide rugged monolithic construction. The output drivers feature a high pulse current buffer stage designed for minimum driver cross conduction. Noise immunity features are preferably included by utilizing a low di/dt peak of the gate drives and under voltage lockout (UVLO) hysteresis of approximately 1V. In addition the control circuit 10 includes over voltage control features for the lamps 14 as well.

The ballast control circuit 10 is provided with power in the form of a supply voltage supplied at the VCC pin (pin 1) through the supply resistor RSUPPLY. The output pin HO (pin 15) and the output pin LO (pin 13) are connected to the high side and low side MOSFETS MHS, MLS, respectively, of the half-bridge 12 which are used to provide power to the CCFL lamps 14. While FIG. 1 is described with reference to CCFL lamps, the circuit 10 would also be suitable to control power supplied to EEFL lamps as well. A bootstrap capacitor CBS is used to provide an increased voltage to the pin VB for the high side driver circuitry 308 (see FIG. 3) in a known manner. The high side and low side MOSFETS MHS, MLS of the half-bridge 12 provide a high frequency switching voltage across the primary winding LT1 of the step-up transformer T1 through the DC blocking capacitor CDC. The DC bus voltage DC BUS across which the half-bridge 12 is connected, may vary depending on whether a TV, or monitor is being backlight, that is, what voltage bus is available. For example, buses may be as low as 12V for a small monitor, or as high as 400V for a large TV. The ballast control circuit 10 of the present application is better suited for use with larger TV screens using a DC bus voltage of between 100V and 400V. Smaller monitors may use simpler and cheaper solutions based on low voltage flyback topology.

The running voltage varies depending on lamp length, however, this voltage is typically in the vicinity of 1000 Vrms and therefore the step-up transformer T1 is used to provide sufficiently high voltage to the lamps 14. Where the lamp 14 is dimmed by burst mode dimming, the lamp needs to reignite at the start of each burst and there must be sufficient voltage to allow for this. The parallel resonance capacitor CRES is thus connected to the primary winding LT1 of the transformer T1. The transformer T1 is designed with a specific primary leakage inductance which forms a parallel resonant tank when connected to CRES in order to ensure there is sufficient voltage to reignite the lamp(s) 14.

Figure 2B:
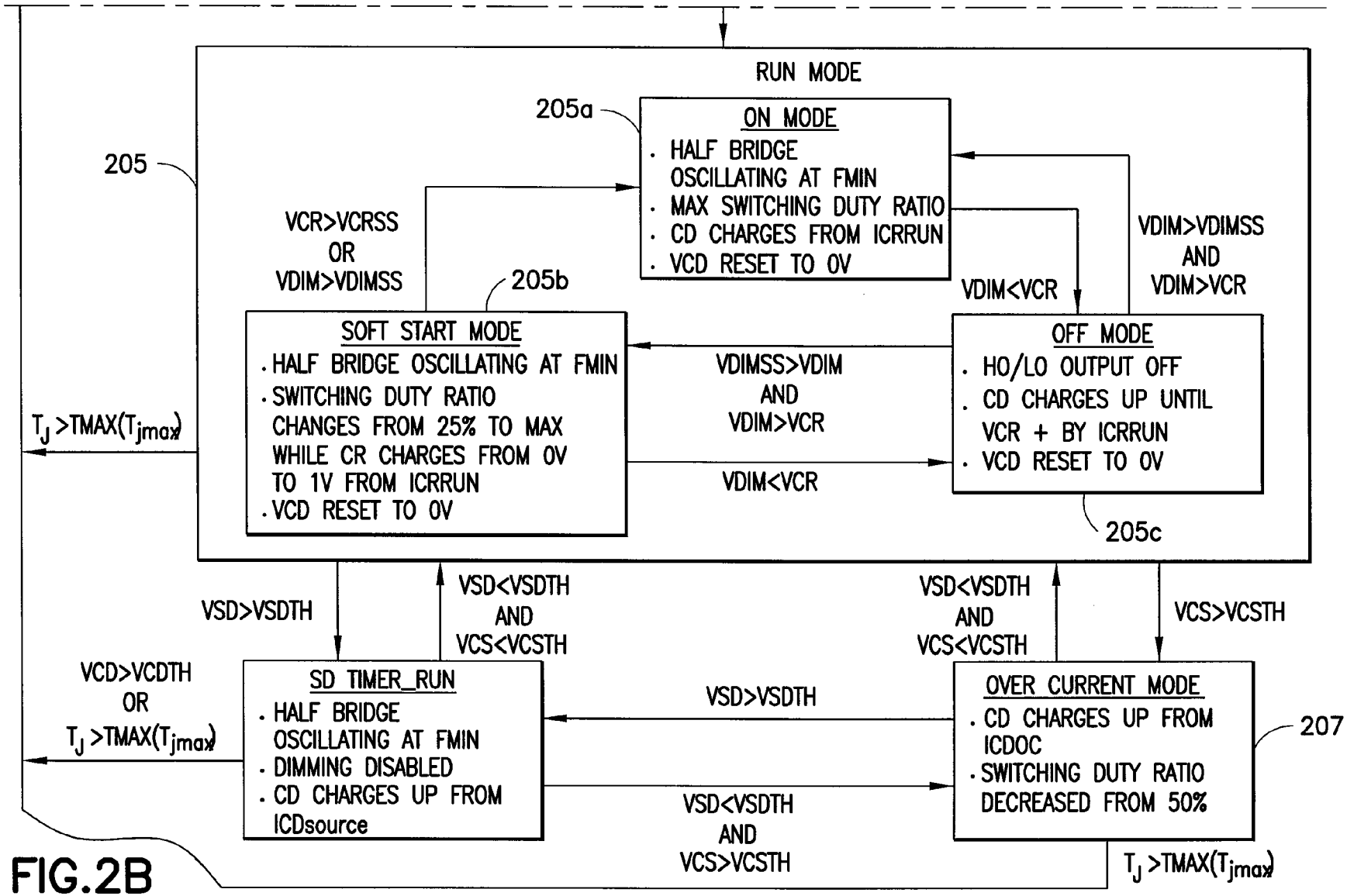

The state diagram of FIGS. 2A-2B illustrate the various modes in which the control circuit 10 operates the half-bridge 12. As indicated in FIGS. 2A-2B, during RUN MODE 205, the half-bridge 12 operates at a fixed frequency which is close to resonance so that a high voltage is provided to the transformer primary coil LT1 before the lamp(s) 14 are ignited and there is no load. When the lamp 14 is running, the frequency will remain the same, however, the resonant frequency of the circuit will drop slightly allowing soft switching of the half-bridge 12 to occur. The control circuit 10 has an adjustable dead time that set via an external resistor RDT (See FIG. 1, for example). As can be seen in FIG. 1, a snubber capacitor CSNUB may be included as a means for boosting the supply voltage provided to the input pin VCC, or simply as an aid to soft switching if the supply voltage is supplied through other means.

Referring again to FIG. 1, two CCFL lamps 14 are preferably connected in parallel to the output of the half-bridge 12 via the transformer T1. Each lamp 14 requires only a small series capacitor CLAMP1, CLAMP2, respectively, to limit the current and provide some voltage, which will allow current sharing between the lamps. An additional transformer, or other similar device is preferably provided to provide current balancing to ensure that the current in each of the lamps 14 is substantially equal to that in the other lamp. The series capacitors CLAMP1, CLAMP2 allow the voltage developed in the secondary coil S of the transformer T1 to be significantly higher than the lamp voltage. This is beneficial since, at ignition, one lamp 14 will ignite first. The ignition of one lamp 14 should not pull down the secondary voltage so much that it would not be sufficient to ignite the other lamps. In effect, the series capacitor(s) CLAMP1, CLAMP2 allow for the ignition of multiple parallel CCFL lamps. It is noted, however, that a series capacitor is generally not necessary for EEFL lamps, since these lamps typically include a built in series capacitance that performs the same task.

The ignition of the lamps 14 is controlled by the control circuit 10 in accordance with the sequence illustrated in FIGS. 2A-2B. After the power is turned ON 200 the control circuit enters UVLO MODE 201, where the half-bridge 12 is OFF, and the supply voltage begins to built at the VCC pin (pin 1). When the supply voltage at pin VCC first exceeds a defined level (VCCUV+) and the enabling voltage VENA at the enable pin ENA (pin 8) exceeds an enable threshold ENATH, the frequency of the circuit is set to its maximum level (FMAX) and the IGNITION MODE 202 begins. As illustrated in FIG. 3, this comparison may be made by the comparator 300 and the enable threshold ENATH may be set at 2V, for example. The UVLO device 301 (see FIG. 3) determines whether the supply voltage at the pin VCC is greater than the defined level (VCCUV+). The enable pin ENA thus provides a logic level input that allows shutdown of the half-bridge 12 by means of a digital control signal, at any time.

The control circuit 10 then triggers IGNITION MODE 202 where the half-bridge 12 is turned ON and oscillates at the maximum frequency FMAX. The timing capacitor (CR) connected to the timing pin CR (pin 9) is charged from zero by a current source, for example, current source 302 which provides the current ICR_IGN, within the control circuit 10 (see FIG. 3). The capacitor CR continues to charge until the voltage at the pin CR reaches a timing threshold (VCR+). This charging process provides a programmable delay for the ignition sequence based on the value of the capacitor CR. During this period, the lamps 14 are ignited, however, at FMAX, the lamps will run at a reduced current until the end of the ignition period is reached, that is, when the voltage at the pin CR reaches the timing threshold voltage VCR+. Thus, the voltage at the timing pin CR sets the timing for the IGNITION MODE 202.

The control circuit 10 also controls the half-bridge 12 such that the duty cycle of the high side MOSFET MHS indicated at the high side control signal that is output at pin HO (pin 15) may be changed. Since the dead time is fixed based on the dead time resistor RDT, and the dead time device 311, the duty cycle of the low side MOSFET MLS will increase when the duty cycle of the high side MOSFET MHS is reduced. The maximum duty cycle of the high side MOSFET MHS is preferably close to 50% but not exactly 50% because the dead time must be subtracted. The minimum duty cycle of the high side MOSFET MHS is preferably approximately 10%. The control of the duty cycle allows the output power of the half-bridge 12 to be reduced, while maintaining a constant frequency, and thus, preventing flicker. That is, the duty cycle of the high side MOSFET MHS can be increased or decreased to increase or decrease the power output of the half bridge 12 while the frequency remains substantially the same. As a result, there is less danger that frequency changes will result in flicker in the lamps 14.

If the lamps 14 have not ignited within the time set at the timing pin CR, FAULT MODE 203 is triggered, as is indicated in FIGS. 2A-2B. In FAULT MODE 203, the half-bridge 12 is turned OFF. The control circuit 10 detects whether or not the lamps 14 have ignited by sampling the voltage VCS at the current sense pin CS (pin 12) when the voltage at timing pin CR exceeds VCR+, that is, at the end of the IGNITION MODE 202. If this voltage is above an ignition threshold (VCSIGN) the control circuit 10 will register a successful ignition, indicted by the block labeled IGNITION DETECTION 204 in FIGS. 2A-2B, for example. If not, FAULT MODE 203 begins. The CS pin voltage is derived from the sum of the lamp currents, which are fed back to the control circuit 10 by means of a small current transformer T2 via the diode DCS and the resistor RCS1. This method is used in order to ensure that the lamps 14 remain galvanically isolated from the half-bridge circuitry 12 and the supply voltage at pin VCC, for safety reasons. After ignition has been successfully detected, that is, when the voltage VCS at the CS is greater than the threshold VCSIGN, the control circuit 10 will enter the RUN MODE 205.

In RUN MODE 205, the frequency preferably switches directly to FMIN. While it is preferable that no sweep time be included in this transition, sweep may be included by adding a resistor between the MAX pin (pin 6) and the COM pin (pin 2). The frequencies FMAX and FMIN of the control circuit 10 are determined by the values of the external resistors RMAX and RMIN. This is described in further detail below. In particular, the frequency is determined by the current flowing out of the MIN pin (pin 5) to the COM pin. During IGNITION MODE 202, the MAX pin is switched internally to COM, preferably, by the switch M1 in FIG. 3, for example, and during RUN MODE 205, it is open, that is the switch M1 is OFF. The switch M1 is preferably controlled by the ignition logic device 303. The voltage at the MIN pin is always 5V as can bee seen with reference to FIG. 3, and so the resistor RMIN will determine the current at the MIN pin during RUN MODE 205 and the parallel combination of RMIN and RMAX will determine the current at the MIN pin during IGNITION MODE 202. Thus, the minimum and maximum frequencies of the control circuit 10 are easily programmable based on the values of the resistors RMIN and RMAX. The relationship of the resistors RMIN and RMAX to the minimum frequency FMIN and the maximum frequency FMAX is described in further detail below.

The control circuit 10 also preferably includes protection against an open load condition. Since the output voltage of the half-bridge 12 can be in excess of 1000V peak to peak, it is essential that the half-bridge is shut down in the case of an open circuit at the load, otherwise there will be a substantial risk of electric shock, or arcing, caused by electrical discharge that may cause something to catch fire. The open load protection in the control circuit 10 is realized by means of the shut down pin SD (pin 11) of the control circuit 10. If the voltage VSD at the SD pin exceeds a shut down threshold (VSDTH) and this condition continues for a defined period of time, the control circuit 10 will shut down the half-bridge 12 and enter FAULT MODE 203 as can be seen with reference to FIGS. 2A-2B. The voltage VSD on the SD pin is provided from an auxiliary secondary coil A in the transformer T1 and indicates the voltage across the lamps 14. The defined period of time is set via the CD pin (pin 9). If the voltage at SD exceeds the threshold VSDTH, then the capacitor CD connected to the CD pin will charge through an internal current source, for example source 304 which provides the current ICD in FIG. 3, for example to the pin CD. If at any time the voltage at SD drops below the VSDTH, the voltage at the CD pin will be reset to zero, thus resetting the timer. That is, the voltage at the pin CD is discharged through the switch M2, for example, in FIG. 3. When the voltage at the CD pin exceeds the threshold (VCDTH) the ballast control circuit 10 will enter FAULT MODE 203 as can be seen in FIGS. 2A-2B. The timing is represented in FIGS. 2A-2B in the block labeled SD TIMER_IGN 206. The over voltage protection function also operates in the same way, during RUN MODE 205.

During RUN MODE 205, that is, after the lamps 14 have been successfully ignited and no faults are present, the duty cycle control of the control circuit 10 is enabled. The duty cycle control by the duty cycle control device 315 remains enabled during SOFT START MODE 205*b* and OVER CURRENT MODE 207 as well. During RUN MODE, the burst mode dimming function is also operational. Thus, RUN MODE 205 includes an ON MODE 205*a* and OFF MODE 205*c* where the lamps 14 are turned OFF as a result of the input on the DIM pin (pin7). The dimming level is determined by the voltage applied externally to the DIM pin, such that when zero volts is applied to the DIM pin, no output voltage for the lamps 14 is provided and OFF MODE 205*c* begins. A voltage greater than VCR+ will produce a continuous output such that the control circuit 10 remains in ON MODE 205*a*. In RUN MODE 205, the CR pin produces a ramp waveform by charging the capacitor CR from an internal current source, for example source 305 of FIG. 3, which provides current ICR_RUN, and resetting the voltage to zero, via the switch M3 for example in FIG. 3, periodically when it reaches the VCR+ threshold in a manner similar to that described above. Thus, the CR pin is used for two distinct functions, i.e. for ignition timing as noted above, and for generating a dimming ramp in RUN MODE 205. The DC voltage applied to the DIM pin is compared with the dimming ramp, via comparator 306 for example of FIG. 3, to produce an internal signal that controls the beginning and end of each burst of high frequency gate drive waveforms at pin HO and pin LO. That is, the internal signal is provided to the output logic device 307, which in turn controls both the high side driver circuitry 308 and the low side driver circuitry 309 which are used to generate the high side and low side control driving signals provided to the pins HO and LO, respectively. These outputs HO, LO set the duty cycle for the high side MOSFET MHS and the low side MOSFET MLS, respectively.

Figure 5:
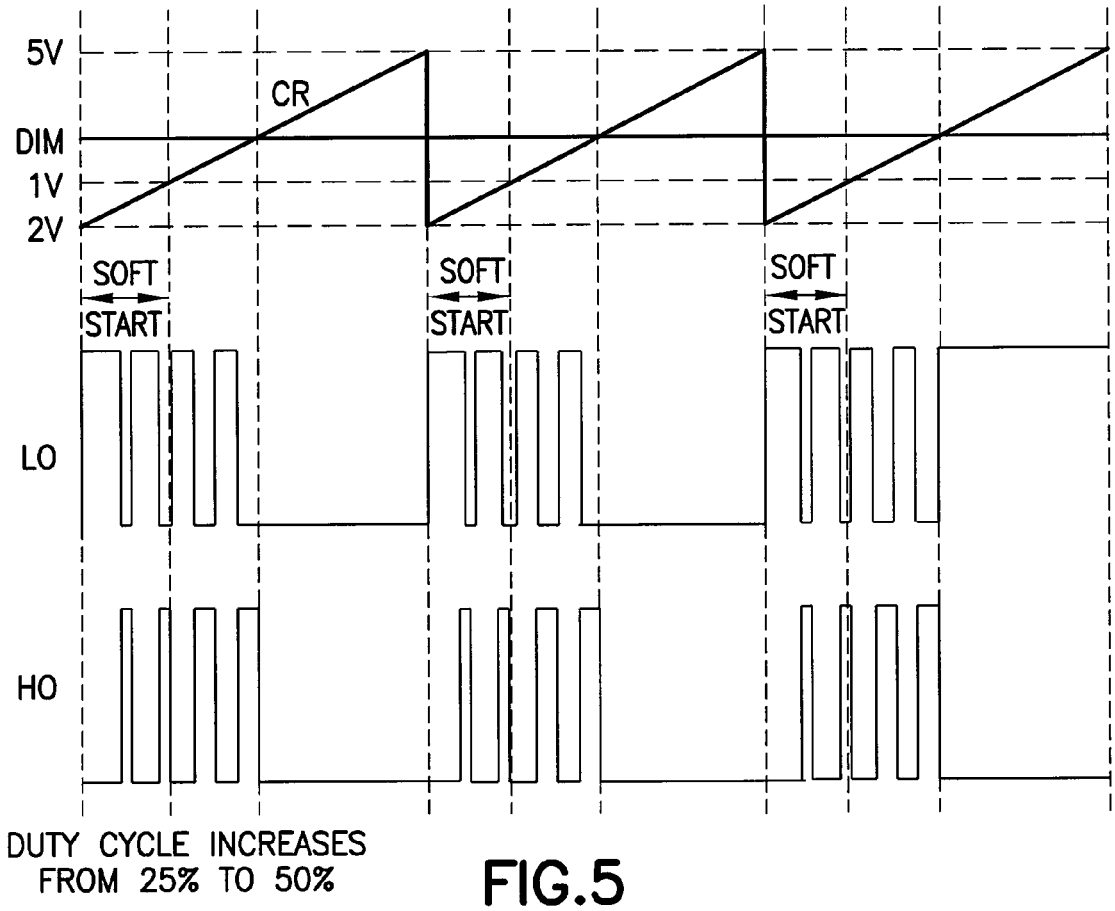
FIG. 5 is a graph illustrating exemplary waveforms of the ballast control circuit of FIG. 1 illustrating soft start and dimming control.

To eliminate stress on the lamps 14 and optimize lamp life, a soft start is provided at the beginning of each burst, that is, when the voltage at the pin CR ramps from zero to 1V. Thus, the control circuit enters SOFT START MODE 205 controlled by the soft start device 314. The output logic device 307 in the ballast control circuit 10 causes the duty cycle provided at pin HO to be approximately 10% at the beginning of each output burst, when the voltage at CR is at zero using the duty cycle device 315. As the voltage VCR at pin CR linearly increases to 1V, the duty cycle indicated at HO will increase proportionally, until it reaches it maximum, which is close to 50%, when the voltage at the pin CR reaches 1V. The waveform illustrated in FIG. 5 illustrates both the dimming operation and the soft start features provided by the ballast control circuit 10. When the value of the voltage on the DIM pin is less than that at the CR pin, the half-bridge is OFF, that is OFF MODE 205*c* is triggered. As noted above, the voltage at the CR pin is ramp shaped and increases from 0V to a maximum of approximately 5V (VCR+). At the beginning of the burst, that is when the voltage at the DIM pin exceeds that of the CR ramp waveform, the duty cycle of the high side MOSFET MHS is kept low until the voltage at the pin CR reaches 1V. Thereafter, the duty cycle is set at its maximum. In this way, the current is reduced at the start of each dimming burst and increases linearly to its nominal value during the first part of each burst.

The maximum current provided to the lamps 14 is limited when the control circuit 10 enters the OVER CURRENT MODE 207 from the RUN MODE 205. This occurs when the voltage VCS at the pin CS exceeds a threshold VCSTH as shown in FIGS. 2A-2B. The sum of the lamp currents is sensed at the CS pin in RUN MODE 205 in the same manner as in the IGNITION MODE 202 described above. In RUN MODE 205, if the current indicated at the pin CS exceeds the threshold VCSTH, the ballast control circuit 10 enters OVER CURRENT MODE 207, as noted above, unless the voltage VSD at the SD pin voltage is exceeding the threshold VSDTH, in which case the control circuit 10 will enter SD TIMER_RUN mode (see FIGS. 2A-2B). The open load protection provided by the SD pin takes precedence over the over current protection provided by the CS pin because an open load condition is deemed to be more dangerous due to the potential fire risk, and also to prevent conflict between different modes of operation.

The CD pin is used in OVER CURRENT MODE 207 to provide timing in the same way as described above. The voltage VCD at the pin CD charges from zero to VCDTH and at that point, the control circuit 10 enters FAULT MODE 203 and shuts down as can be seen in FIGS. 2A-2B. That is, the voltage VCD at the pin CD sets the time period of the OVER CURRENT MODE 207. The important difference is that in OVER CURRENT MODE 207, the ballast output current is regulated by means of reducing the indicated duty cycle on the HO pin via over current device 316. As the voltage at pin CD increases from zero volts, the duty cycle indicated at pin HO begins to reduce linearly from maximum duty cycle. As the same time, the output current provided by the half-bridge 12 begins to fall and at some point may fall sufficiently for the voltage fed back to the CS pin to fall below the threshold. Some hysteresis has been included in the over current comparator 313 (See FIG. 3) within the control circuit 10 as well as the SD comparator 317 in order to prevent possible instability when the voltage is regulating around the threshold. In this manner, the CD pin voltage is held at some point above zero but below VCDTH and the indicated duty cycle at HO is held at some intermediate level between 10% and the maximum, thus regulating the lamp current. If the voltage VCS remains above VCSTH even when the indicated duty cycle at pin HO is reduced, then the CD pin voltage will continue to increase as the capacitor charges, until it reaches the threshold VCDTH. The control circuit 10 will shut down and enter FAULT MODE 203 when this occurs. The duty cycle indicated at the output pin HO drops linearly from the maximum to 10% as the voltage at pin CD increases from zero to VCDTH.

The dead time set by the control circuit 10 does not appear at the end of each CT ramp as common in other ballast control circuits where the duty cycle does not need to vary. These other circuits thus require a separate timing ramp to produce the delay for the dead time, which is not required in the present application.

The following formulas provide the means to calculate the external resistor and capacitor values required to give desired frequencies FMIN, FMAX and dead time in the control circuit 10.

The running frequency (FMIN) of the control circuit 10 is based on the following:

$$F_{\mathrm{MIN}} = \frac{1}{2 \cdot C_T \cdot R_{\mathrm{MIN}}}$$

where VMIN=5V, i.e. when the ignition ramp is complete and RMAX has no further effect on the oscillator. The ignition frequency (FMAX) is provided as follows:

$$F_{\mathrm{MAX}} = \frac{R_{\mathrm{MIN}} + R_{\mathrm{MAX}}}{2 \cdot C_T \cdot R_{\mathrm{MIN}} \cdot R_{\mathrm{MAX}}}$$

The dead time is calculated in accordance with the following:

$$T_{DT} = R_{DT} \cdot C_{DT} \cdot \ln(1.5) = 0.405 \cdot R_{DT} \cdot C_{DT}$$

The maximum duty cycle is set as follows:

$$DC_{MAX}=0.5-T_{DT}*F$$

Thus, the control circuit 10 of the present invention provides for an adjustable duty cycle while providing a fixed dead time to allow for a reduction in output power of the half-bridge while the frequency remains substantially the same. In addition, the control circuit provides for soft start while mapping this soft start feature to the voltage VCR at pin CR. The circuit 10 also allows over current control which is linked to a voltage at the pin CD. In addition, the ignition sequence includes a programmed delay to allow the control circuit 10 to be used with both CCFL and EEFL lamps.

Figure 4:
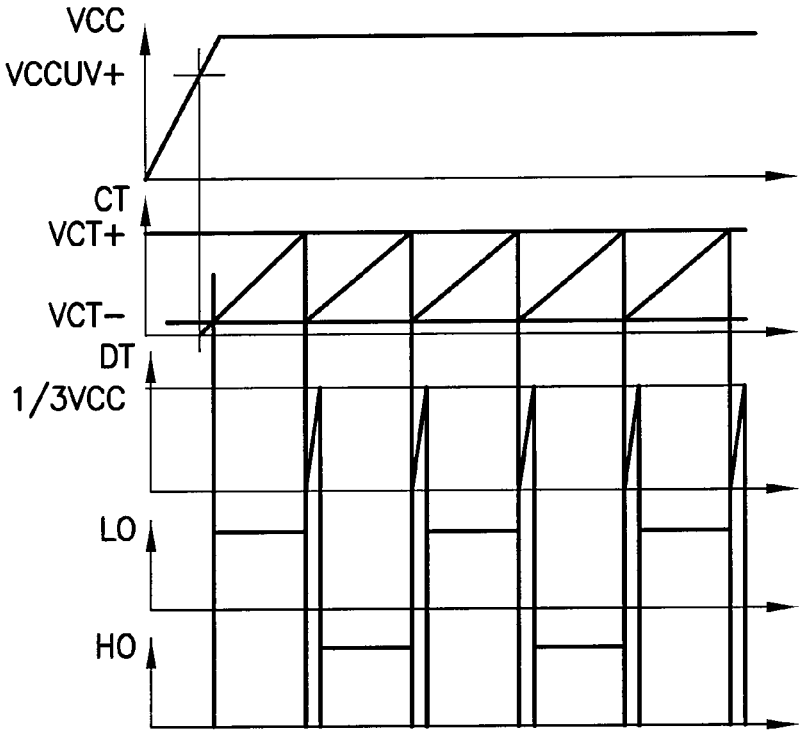
FIG. 4 is a graph illustrating certain waveforms of the ballast control circuit of FIG. 1.

FIG. 4 is an illustration of the waveforms of the circuit of FIGS. 1 and 3. As illustrate, until the supply voltage at VCC reaches the threshold VCCUV+ the half bridge is kept OFF. Thereafter the values at the output pins LO and HO are alternated with a dead time in between indicated by the graph of the voltage at DT.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ballast control circuit for driving at least one gas discharge lamp comprises:

a high side driver operable to provide a high side driving signal to a high side switch of a half bridge controlled by the ballast control circuit, wherein the high side driving signal indicates a preferred duty cycle for the high side switch;

a low side driver operable to provide a low side driving signal to a low side switch of the half bridge, wherein the low side driving signal indicates a preferred duty cycle for the low side switch;

a dead time control circuit operable to provide a dead time signal that indicates a dead time during which both the high side and low side switches are turned OFF, wherein the dead time is set based on a value of an external dead time resistor; and dimming circuitry operable to selectively dim the at least one gas discharge lamp, wherein the dimming circuitry dims the at least one gas discharge lamp based on a comparison between a dimming input and a voltage at a first timing pin of the ballast control circuit.

2. The ballast control circuit of claim 1, wherein the duty cycle of the high side switch is adjusted via the high side driver while the dead time remains constant.

3. The ballast control circuit of claim 2, wherein the voltage at the first timing pin changes based on a value of a first timing capacitor connected to the first timing pin.

4. The ballast control circuit of claim 3, wherein the high side and low side switches are turned OFF when the dimming input is lower than the voltage at the first timing pin.

5. The ballast control circuit of claim 4, wherein the duty cycle of the high side switch is maintained at a reduced level for a soft start period of time when the voltage at the first timing pin is less than the dimming input and the value of the dimming input is lower than a soft start threshold value.

6. The ballast control circuit of claim 5, wherein the soft start threshold value is 1 volt and the soft start period of time is the time it takes for the voltage at the first timing pin to change from 0 volts to 1 volt.

7. A ballast control circuit for driving at least one gas discharge lamp comprises:

a high side driver operable to provide a high side driving signal to a high side switch of a half bridge controlled by the ballast control circuit, wherein the high side driving signal indicates a preferred duty cycle for the high side switch;

a low side driver operable to provide a low side driving signal to a low side switch of the half bridge, wherein the low side driving signal indicates a preferred duty cycle for the low side switch;

a dead time control circuit operable to provide a dead time signal that indicates a dead time during which both the high side and low side switches are turned OFF, wherein the dead time is set based on a value of an external dead time resistor; and over current protection circuitry operable to turn the ballast control circuit OFF when a current sense input indicative of the current provided to the gas discharge lamp exceeds an over current threshold value for a predetermined period of time.

8. The ballast control circuit of claim 7, wherein the predetermined period of time is based on a value of a second timing capacitor connected to a second timing pin.

9. The ballast control circuit of claim 8, wherein the predetermined period of time ends when the voltage at the second timing pin exceeds a second threshold value.

10. The ballast control circuit of claim 9, further comprising shut down circuitry operable to turn the ballast control circuit OFF when a lamp voltage signal indicative of a voltage provided across the gas discharge lamp exceeds a shut down threshold for the predetermined period of time.

11. The ballast control circuit of claim 10, wherein the predetermined period of time is based on the voltage of the second timing capacitor connected to the second timing pin.

12. The ballast control circuit of claim 11, where in the predetermined period of time ends when the voltage at the second timing pin exceeds a second threshold value.

13. The ballast control circuit of claim 2, wherein the high side driver and the low side driver are driven at a maximum frequency for an ignition period of time at start up, such that the at least one gas discharge lamp is provided with a voltage sufficient to ignite the at least one gas discharge lamp.

14. The ballast control circuit of claim 13, wherein the ignition period of time is based on the voltage at the first timing pin.

15. The ballast control circuit of claim 14, wherein the voltage at the first timing pin changes based on a value of a first timing capacitor connected to the first timing pin.

16. The ballast control circuit of claim 15, wherein the ballast control circuit is turned OFF after the ignition period when the at least one gas discharge lamp does not ignite.

17. The ballast control circuit of claim 16, wherein the determination that the at least one gas discharge lamp has not ignited is based on a comparison of a lamp voltage signal indicative of the voltage across the at least one gas discharge lamp with an ignition value such that the at least one gas discharge lamp has ignited when the lamp voltage signal exceeds the ignition value.

18. The ballast control circuit of claim 17, wherein the high side driver and the low side driver are driven at a minimum after the at least one gas discharge lamps is ignited.

* * * * *